US011397015B2

(12) United States Patent
Song et al.

(10) Patent No.: US 11,397,015 B2
(45) Date of Patent: Jul. 26, 2022

(54) AIR CONDITIONING APPARATUS

(71) Applicant: LG Electronics Inc., Seoul (KR)

(72) Inventors: Chiwoo Song, Seoul (KR); Yongcheol Sa, Seoul (KR); Ilyoong Shin, Seoul (KR); Jisung Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 128 days.

(21) Appl. No.: 16/849,656

(22) Filed: Apr. 15, 2020

(65) Prior Publication Data

US 2020/0326092 A1 Oct. 15, 2020

(30) Foreign Application Priority Data

Apr. 15, 2019 (KR) ..... 10-2019-0043971

(51) Int. Cl.

| | |
|---|---|
| ***F24F 5/00*** | (2006.01) |
| ***F24F 11/84*** | (2018.01) |
| ***F24F 1/14*** | (2011.01) |
| ***F24F 1/28*** | (2011.01) |
| ***F24F 11/67*** | (2018.01) |

(52) U.S. Cl.

CPC ..... *F24F 5/00* (2013.01); *F24F 1/14* (2013.01); *F24F 1/28* (2013.01); *F24F 11/84* (2018.01); *F24F 11/67* (2018.01)

(58) Field of Classification Search

CPC .... F25B 2313/02742; F25B 2313/0232; F25B 2313/02323; F25B 2313/02321; F25B 2313/023; F24F 1/28

See application file for complete search history.

(56) References Cited

U.S. PATENT DOCUMENTS

| | | | | |
|---|---|---|---|---|
| 2012/0118005 | A1* | 5/2012 | Yamashita | F25B 25/005 62/513 |
| 2012/0118530 | A1 | 5/2012 | Yamashita et al. | |
| 2015/0027154 | A1 | 1/2015 | Lee et al. | |
| 2019/0063792 | A1 | 2/2019 | Kim et al. | |

FOREIGN PATENT DOCUMENTS

| | | |
|---|---|---|
| EP | 2960602 | 12/2015 |
| EP | 3287715 | 2/2018 |
| JP | 5236080 | 7/2013 |
| KR | 10-2005-0075062 | 7/2005 |
| KR | 10-2018-0080398 | 7/2018 |

OTHER PUBLICATIONS

PCT International Search Report in International Appln. No. PCT/KR2020/001080, dated Apr. 29, 2020, 3 pages.

Extended European Search Report in European Appln. No. 20158141.0, dated Aug. 14, 2020, 4 pages.

* cited by examiner

*Primary Examiner* — Schyler S Sanks

(74) *Attorney, Agent, or Firm* — Fish & Richardson P.C.

(57) ABSTRACT

An air conditioning apparatus includes a heat exchange device that connects an outdoor unit to an indoor unit and that includes a heat exchanger configured to perform heat exchange between refrigerant and water, thereby reducing an amount of refrigerant used to perform a cooling operation or a heating operation. The apparatus further includes a switching mechanism that connects the outdoor unit to the heat exchange device and that is configured to be connected to both a simultaneous outdoor unit and a switchable outdoor unit to thereby allow the heat exchange device to be installed regardless of the type of the outdoor unit.

18 Claims, 9 Drawing Sheets

AIR CONDITIONING APPARATUS

CROSS-REFERENCE TO RELATED APPLICATIONS

The present application claims priority under 35 U.S.C. 119 and 35 U.S.C. 365 to Korean Patent Application No. 10-2019-0043971, filed on Apr. 15, 2019, which is hereby incorporated by reference in its entirety.

TECHNICAL FIELD

The present disclosure relates to an air conditioning apparatus.

BACKGROUND

Air conditioning apparatus can maintain air within a space to be a proper state according to use and purpose thereof. In some examples, an air conditioning apparatus may include a compressor, a condenser, an expansion device, and evaporator. The air conditioning apparatus may perform a refrigerant cycle including compression, condensation, expansion, and evaporation processes with refrigerant. In some cases, the air conditioning apparatus may heat or cool a predetermined space.

The air conditioning apparatus may be used in various places. For example, the air conditioning apparatus may be installed in a space of a home or an office.

In some examples, when the air conditioning apparatus performs a cooling operation, an outdoor heat-exchanger provided in an outdoor unit may serve as a condenser, and an indoor heat-exchanger provided in an indoor unit may serve as an evaporator. In some examples, when the air conditioning apparatus performs a heating operation, the indoor heat-exchanger may serve as the condenser, and the outdoor heat-exchanger may serve as the evaporator.

In some cases, a type and an amount of refrigerant used in the air conditioning apparatus may be limited due to environment regulations. In some cases, to reduce an amount of refrigerant used, an air conditioning system may perform cooling or heating by performing heat exchange between the refrigerant and a predetermined fluid such as water.

In some examples, where the air conditioning apparatus connects a refrigerant circulation circuit and a thermal medium circulation circuit to an outdoor unit, it may be easily used in a condition of simultaneously cooling and heating an indoor space.

In some examples, where the refrigerant circulation circuit and the heat medium circulation circuit are not configured to be connected to the switchable outdoor unit, the air conditioning apparatus may not switch the cooling and heating operations.

SUMMARY

The present disclosure describes an air conditioning apparatus that includes a switching mechanism capable of being connected to a switchable outdoor unit and an outdoor unit, which have internal configurations different from each other. The air conditioning apparatus includes a heat exchange device performing heat exchange between water and a refrigerant, which may increase a degree of freedom of installation.

The present disclosure also describes an air conditioning apparatus including a switching mechanism that is configured to be connected to an outdoor unit through three pipes and to be connected to the switchable outdoor unit through two pipes and that is disposed between a heat exchange device and the outdoor unit so that a heat exchange device performing heat exchange between water and a refrigerant increases a degree of freedom of installation.

The present disclosure further describes an air conditioning apparatus including a switching mechanism that includes a bypass pipe through which a four-way valve and a connection pipe of a refrigerant having a specific pressure to generate a high pressure or a low pressure at a specific port of the four-way valve may communicate with each other so that an internal differential pressure of the four-way valve is used when changing a cooling operation mode or a heating operation mode.

The present disclosure further describes an air conditioning apparatus in which an internal differential pressure may be sufficiently secured to improve operation reliability of a four-way valve in a cooling operation mode or a heating operation mode.

The air conditioning apparatus may include a heat exchange device that is configured to connect an outdoor unit to an indoor unit and that includes a heat exchanger configured to perform heat exchange between a refrigerant and water, thereby reducing an amount of refrigerant used to perform a cooling operation or a heating operation.

A switching mechanism may be configured to connect the outdoor unit to the heat exchange device. For example, the switching mechanism may be connected to both an outdoor unit and a switchable outdoor unit, which have different configurations. The heat exchange device may improve a degree of freedom of installation regardless of the type of outdoor unit.

In some implementations, the switching mechanism may include a plurality of connection pipes through which refrigerants having different pressures flow and a bypass pipe configured to connect the plurality of connection pipes to each other to generate a high pressure or a low pressure in a specific port of a four-way valve, thereby easily and quickly switching a cooling or heating operation.

According to one aspect of the subject matter described in this application, an air conditioning apparatus includes: an outdoor unit configured to circulate refrigerant, the outdoor unit including a compressor and an outdoor heat exchanger; an indoor unit configured to circulate water; a first heat exchanger and a second heat exchanger that are configured to perform heat exchange between the refrigerant and the water; a first four-way valve disposed at one side of the first heat exchanger and configured to adjust a flow direction of the refrigerant in the first heat exchanger; a second four-way valve disposed at one side of second heat exchanger and configured to adjust a flow direction of the refrigerant the second heat exchanger; a first connection pipe connected to the outdoor unit and to a first port of the first four-way valve; a second connection pipe connected to a second port of the first four-way valve and to the first heat exchanger; a third connection pipe connected to a third port of the first four-way valve; a fourth connection pipe connected to the first heat exchanger; a first expansion valve installed at the fourth connection pipe; at least one bypass pipe configured to connect two connection pipes among the first connection pipe, the third connection pipe, and the fourth connection pipe to each other, in which the at least one bypass pipe is configured to guide the refrigerant between the two connection pipes; and at least one bypass valve installed at the at least one bypass pipe.

Implementations according to this aspect may include one or more of the following features. For example, the at least one bypass pipe may include a first bypass pipe connected to a first bypass branch part disposed at the first connection pipe and to a second bypass branch part disposed at the third connection pipe. In some examples, the at least one bypass valve may include a first bypass valve installed at the first bypass pipe. In some examples, the at least one bypass pipe may further include a second bypass pipe connected to a third bypass branch part disposed at the first connection pipe and to a fourth bypass branch part disposed at the fourth connection pipe.

In some implementations, the at least one bypass valve may include a first bypass valve installed at the first bypass pipe and a second bypass valve installed at the second bypass pipe. In some examples, the at least one bypass pipe may further include a third bypass pipe connected to a fifth bypass branch part disposed at the third connection pipe and to a sixth bypass branch part disposed at the fourth connection pipe. In some examples, the at least one bypass valve may include a third bypass valve installed at the third bypass pipe.

In some implementations, the air conditioning apparatus may further include a first check valve installed at the first bypass pipe, a second check valve installed at the second bypass pipe, and a third check valve installed at the third bypass pipe. In some examples, the third check valve may be installed at a point between the second bypass branch part and the fifth bypass branch part.

In some implementations, the air conditioning apparatus may further include: a first branch part disposed at the first connection pipe; and a fifth connection pipe connected to the first branch part and to a first port of the second four-way valve. In some examples, the air conditioning apparatus may further include: a sixth connection pipe connected to a second port of the second four-way valve and to the second heat exchanger.

In some implementations, the air conditioning apparatus may further include: a second branch part disposed at the third connection pipe; a third branch part disposed at the fourth connection pipe; a seventh connection pipe connected to the second heat exchanger and to the third branch part; and a second expansion valve installed at the seventh connection pipe. In some implementations, the air conditioning apparatus may further include: an eighth connection pipe connected to the second branch part and to a third port of the second four-way valve.

In some implementations, the air conditioning apparatus may further include: a first outdoor unit connection pipe disposed in the outdoor unit and connected to the first connection pipe; a second outdoor unit connection pipe disposed in the outdoor unit and connected to the third connection pipe; and a third outdoor unit connection pipe disposed in the outdoor unit and connected to the fourth connection pipe. In some implementations, the air conditioning apparatus may further include: a first outdoor unit connection pipe connected to the outdoor unit and to the third connection pipe; and a second outdoor unit connection pipe connected to the outdoor unit and to the fourth connection pipe.

In some implementations, the indoor unit may include: a first indoor unit connected to the first heat exchanger; and a second indoor unit connected to the second heat exchanger.

According to another aspect, an air conditioning apparatus includes: an outdoor unit configured to circulate refrigerant; an indoor unit configured to circulate water; a first heat exchanger and a second heat exchanger that are configured to perform heat exchange between the refrigerant and the water, each of the first heat exchanger and the second heat exchanger being fluidly connected to the outdoor unit and the indoor unit; a first four-way valve disposed at one side of the first heat exchanger and configured to adjust a flow direction of the refrigerant in the first heat exchanger; a second four-way valve disposed at one side of second heat exchanger and configured to adjust a flow direction of the refrigerant in the second heat exchanger; a first connection pipe connected to the outdoor unit and to a first port of the first four-way valve; a second connection pipe connected to a second port of the first four-way valve and to the first heat exchanger; a third connection pipe connected to a third port of the first four-way valve; a first bypass pipe connected to a first bypass branch part disposed at the first connection pipe and to a second bypass branch part disposed at the third connection pipe; and a first bypass valve installed at the first bypass pipe.

Implementations according to this aspect may include one or more of the following features. For example, the air conditioning apparatus may further include: a fourth connection pipe connected to the first heat exchanger; a first expansion valve installed at the fourth connection pipe; a second bypass pipe connected to a third bypass branch part disposed at the first connection pipe and to a fourth bypass branch part disposed at the fourth connection pipe; and a second bypass valve installed at the second bypass pipe.

In some implementations, the air conditioning apparatus may further include: a third bypass pipe connected to a fifth bypass branch part disposed at the third connection pipe and to a sixth bypass branch part disposed at the fourth connection pipe; and a third bypass valve installed at the third bypass pipe. In some implementations, the air conditioning apparatus may further include: a fifth connection pipe connected to a first branch part disposed at the first connection pipe and to a first port of the second four-way valve; a sixth connection pipe connected to a second port of the second four-way valve and to the second heat exchanger; a seventh connection pipe connected to the second heat exchanger and to a third branch part disposed at the fourth connection pipe; and a second expansion valve installed at the seventh connection pipe.

The details of one or more implementations are set forth in the accompanying drawings and the description below. Other features will be apparent from the description and drawings, and from the claims.

DETAILED DESCRIPTION

Hereinafter, exemplary implementations will be described with reference to the accompanying drawings. The disclosure may, however, be implemented in many different forms and should not be construed as being limited to the implementations set forth herein; rather, that alternate implementations included in other retrogressive disclosures or falling within the spirit and scope of the present disclosure will fully convey the concept of the disclosure to those skilled in the art.

Figure 1:
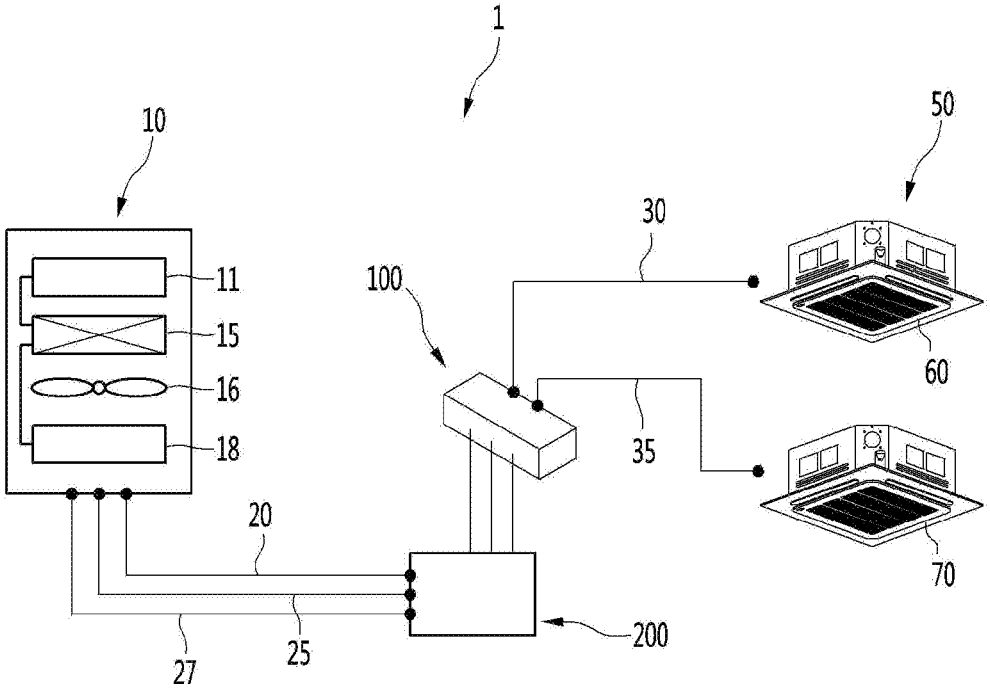
FIG. 1 is a schematic view illustrating an example configuration of an air conditioning apparatus.

FIG. 1 is a schematic view illustrating an example configuration of an air conditioning apparatus.

Referring to FIG. 1, an air conditioning apparatus 1 includes an outdoor unit 10, an indoor unit 50, a switching mechanism 200 connected to the outdoor unit 10, and a heat exchange device 100 connected to the switching mechanism 200. The switching mechanism 200 may be provided between the outdoor unit 10 and the heat exchange device 100.

The switching mechanism 200 is provided so that the heat exchange device 100 is connected to a cooling/heating switching outdoor unit or a simultaneous cooling/heating outdoor unit. The switching mechanism 200 may be provided as a separate kit that is detachable to the outdoor unit or may be integrated with the outdoor unit.

In some implementations, the outdoor unit 10 may be provided as the simultaneous cooling/heating outdoor unit. For example, the outdoor unit 10 may be one device that can perform both of a cooling operation and a heating operation simultaneously or selectively. In some cases, the outdoor unit 10 may be provided as separate a cooling outdoor unit and a heating outdoor unit.

The outdoor unit 10, the switching mechanism 200, and the heat exchange device 100 may be fluidly connected to each other by a first fluid. For example, the first fluid may include a refrigerant. The refrigerant may be configured to flow through a refrigerant-side flow path of a heat exchanger provided in the heat exchange device 100, the switching mechanism 200, and the outdoor unit 10.

The outdoor unit 10 may include a compressor 11 and an outdoor heat exchanger 15. An outdoor fan 16 may be provided at one side of the outdoor heat exchanger 15 to blow external air toward the outdoor heat exchanger 15 so that heat exchange between the external air and the refrigerant of the outdoor heat exchanger 15 is performed. Also, the outdoor unit 10 may further include a main expansion valve 18 (EEV).

The air conditioning apparatus 1 may further include three pipes 20, 25, and 27 connecting the outdoor unit 10 to the switching mechanism 200. The three pipes 20, 25, and 27 include a first outdoor unit connection pipe 20 as a "high-pressure pipe" through which a high-pressure gas refrigerant flows, a second outdoor unit as a "low-pressure pipe" through which a low-pressure gas refrigerant flows, and a third outdoor unit connection pipe 27 as a "liquid pipe" through which a liquid refrigerant flows. That is, the outdoor unit 10 and the switching mechanism 200 may have a "three pipe connection structure", and the refrigerant may circulate through the outdoor unit 10 and the heat exchange device 100 via the three pipes 20, 25, and 27.

The heat exchange device 100 and the indoor unit 50 may be fluidly connected by a second fluid. For example, the second fluid may include water. The water may flow through a water-side flow path of a heat exchanger provided in the heat exchange device 100 and the indoor unit 50.

That is, the heat exchanger includes the refrigerant-side flow path and the water-side flow path. For example, the heat exchanger may include a plate-type heat exchanger in which the water and the refrigerant are heat-exchanged with each other.

The indoor unit 50 may include a plurality of indoor units 60 and 70. The plurality of indoor units 60 and 70 include a first indoor unit 60 and a second indoor unit 70. Although two indoor units are connected to the heat exchange device 100 in FIG. 1, the implementation is not limited thereto. For example, three or more indoor units may be connected to the heat exchange device 100.

The air conditioning apparatus 1 may further include pipes 30 and 35 connecting the heat exchange device 100*a* to the indoor unit 50. The pipes 30 and 35 include a first indoor unit connection pipe 30 connecting the heat exchange device 100*a* to the first indoor unit 60 and a second indoor unit connection pipe 35 connecting the heat exchange device 100*a* to the second indoor unit 70.

The water may circulate through the heat exchange device 100*a* and the indoor unit 50 via the first and second indoor unit connection pipes 30 and 35. As the number of indoor units increases, the number of pipes connecting the heat exchange device 100*a* to the indoor units may also increase.

In some implementations, the refrigerant circulating through the outdoor unit 10, the switching mechanism 200, and the heat exchange device 100 and the water circulating through the heat exchange device 100 and the indoor unit 50 may be heat-exchanged with each other through the heat exchangers 110 and 115 (see FIG. 2) provided in the heat exchange device 100. Water cooled or heated through the heat exchange may be heat-exchanged with an indoor heat exchangers 61 and 71 (see FIG. 2) provided in the indoor unit 50 to perform cooling or heating in an indoor space.

Figure 2:
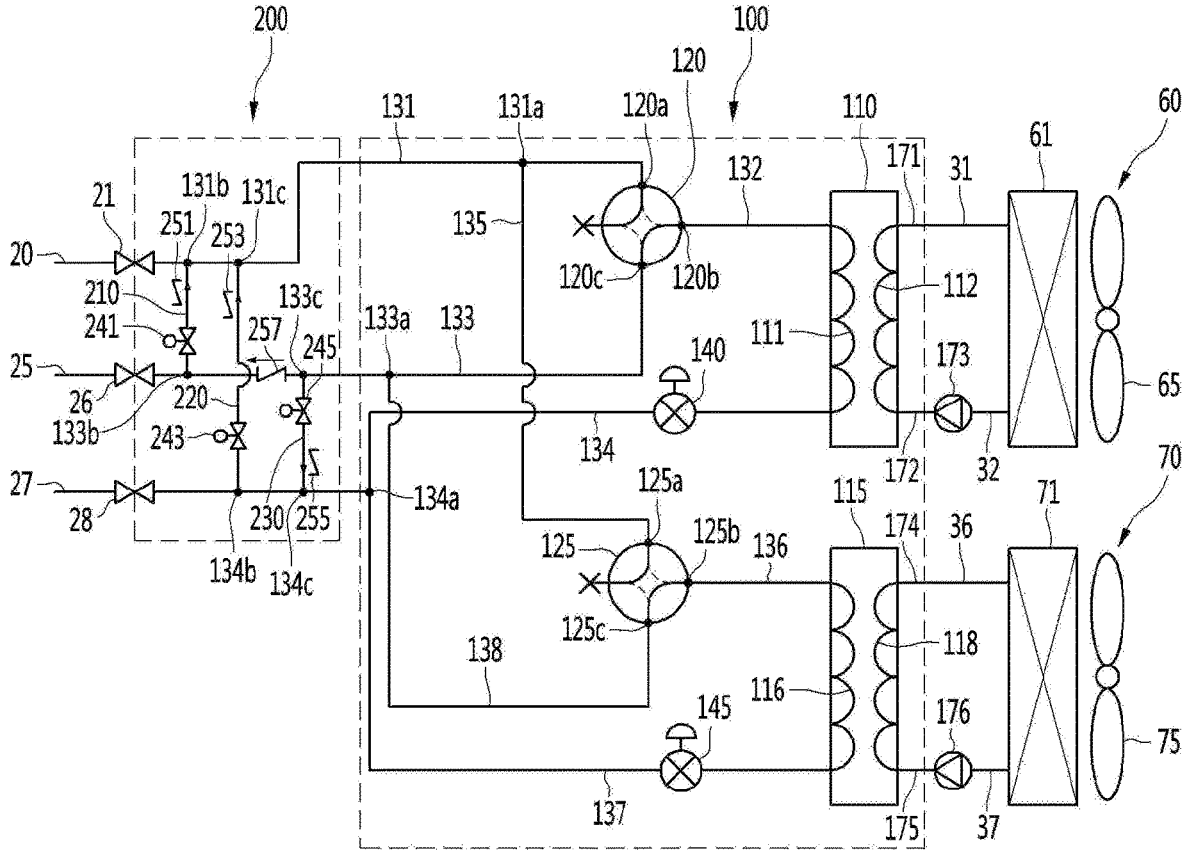
FIG. 2 is a cycle diagram illustrating an example configuration of a heat exchange device and a switching mechanism.

FIG. 2 is a cycle diagram illustrating an example configuration of the heat exchange device and the switching mechanism.

Referring to FIG. 2, the switching mechanism 200 includes a first connection pipe 131 connected to a first outdoor unit connection pipe 20 through a first service valve 21. The first connection pipe 131 may extend into the heat exchange device 100 and may be connected to a first port 120*a* of the first four-way valve 120.

The switching mechanism 200 further includes a third connection pipe 133 connected to a second outdoor unit connection pipe 25 through a second service valve 26. The third connection pipe 133 may extend into the heat exchange device 100 and may be connected to a third port 120*c* of the first four-way valve 120.

The switching mechanism 200 further includes a fourth connection pipe 134 connected to a third outdoor unit connection pipe 27 through a third service valve 28. The fourth connection pipe 134 may extend into the heat exchange device 100 and may be connected to the first heat exchanger 110.

The first to third outdoor unit connection pipes 20, 25, and 27 may be connected to the switching mechanism 200 through the first to third service valves 21, 26, and 28, and thus, the outdoor unit 10 and the switching mechanism 200 may be connected to each other through the "three pipes".

The heat exchange device 100 may include heat exchangers 110 and 115, a refrigerant pipe, and a water pipe, and a plurality of valves, and a pump.

In detail, the heat exchange device 100 includes a first heat exchanger 110 fluidly connected to the first indoor unit 60 and a second heat exchanger 115 fluidly connected to the second indoor unit 70.

The first heat exchanger 110 and the second heat exchanger 115 may have the same configuration. The first and second heat exchangers 110 and 115 may include a plate-type heat exchanger and be configured so that the water flow path and the refrigerant flow path are alternately stacked with each other.

The first heat exchanger 110 includes a first refrigerant flow path 111 and a first water flow path 112. One side of the first refrigerant flow path 111 may be connected to the second connection pipe 132. The second connection pipe 132 may extend from a second port 120*b* of the first four-way valve 120 to be connected to the first heat exchanger 110.

The other side of the first refrigerant flow path 111 may be connected to the fourth connection pipe 134. The fourth connection pipe 134 may extend from the third service valve 28 and be connected to the first heat exchanger 110. That is, both sides of the first refrigerant flow path 111 may be connected to the second connection pipe 132 and the fourth connection pipe 134, respectively.

A refrigerant discharged from the outdoor unit 10 may be introduced into the first refrigerant flow path 111 through the first connection pipe 131 and the first four-way valve 120, and a refrigerant passing through the first refrigerant flow path 111 may be introduced into the outdoor unit 10 through the fourth connection pipe 134.

The first water flow path 112 may be fluidly connected to the first indoor unit 60. Thus, the water discharged from the first indoor unit 60 may be 1 introduced into the first water flow path 112, or the water passing through the first water flow path 112 may be introduced into the first indoor unit 60.

The heat exchange device 100 includes a first heat exchanger outlet pipe 171 and a first heat exchanger inlet pipe 172, which are connected to the first water flow path 112 of the first heat exchanger 110. In addition, the first indoor unit connection pipe 30 includes a first indoor unit inlet pipe 31 and a first indoor unit outlet pipe 32.

The first heat exchanger outlet pipe 171 may be connected to the first indoor unit inlet pipe 31. Therefore, the water discharged from the first water flow path 112 of the first heat exchanger 110 may be introduced into the first indoor unit 60 through the first heat exchanger outlet pipe 171 and the first indoor unit inlet pipe 31.

The first indoor unit 60 includes a first indoor heat exchanger 61 and a first indoor fan 65. The first indoor fan 65 is disposed adjacent to the first indoor heat exchanger 61 to blow indoor air so that heat exchange occurs between water passing through the first indoor heat exchanger 61 with the indoor air.

The first indoor unit inlet pipe 31 may be connected to an inlet-side of the first indoor heat exchanger 61. Also, the first indoor unit outlet pipe 32 may be connected to an outlet-side of the first indoor heat exchanger 61.

The first heat exchanger inlet pipe 172 may be provided with a first pump 173 for forcing a flow of water. When the first pump 173 is driven, water may circulate through a water-side flow path connecting the first indoor unit 60 to the first heat exchanger 110, i.e., the first indoor heat exchanger 61, the first indoor unit outlet pipe 32, the first heat exchanger inlet pipe 172, the first water flow path 112, the first heat exchanger outlet pipe 171, and the first indoor unit inlet pipe 31.

Although the first pump 173 is illustrated as being installed in the first heat exchanger inlet pipe 172 in FIG. 2, the first pump 173 may be installed in the first heat exchanger outlet pipe 171. The second heat exchanger 115 includes a second refrigerant flow path 116 and a second water flow path 118. One side of the second refrigerant flow path 116 may be connected to a sixth connection pipe 136. The sixth connection pipe 136 may extend from a second port 125*b* of a second four-way valve 125 to be connected to the second heat exchanger 115.

The other side of the second refrigerant flow path 116 may be connected to a seventh connection pipe 137. The seventh connection pipe 137 may extend from a third branch part 134*a* of a fourth connection pipe 134 and may be connected to the second heat exchanger 115. That is, both sides of the second refrigerant flow path 116 may be connected to the sixth connection pipe 136 and the seventh connection pipe 137.

The refrigerant flowing through the fourth connection pipe 134 may be branched from a third branch part 134*a* to flow through the seventh connection pipe 137 and may be introduced into the second refrigerant flow path 116. Also, the refrigerant flowing through the second refrigerant flow path 116 may be introduced into the second port 125*b* of the second four-way valve 125 via the sixth connection pipe 136 and then be discharged through the third port 125*c*.

The second water flow path 118 may be fluidly connected to the second indoor unit 70, and the refrigerant discharged from the second indoor unit 70 may be introduced into the second water flow path 118, or the refrigerant passing through the second water flow path 118 may be introduced into the second indoor unit 70.

The heat exchange device 100 includes a second heat exchanger outlet pipe 174 and a second heat exchanger inlet pipe 175, which are connected to the second water flow path 118 of the second heat exchanger 115. Also, the second indoor unit connection pipe 35 includes a second indoor unit inlet pipe 36 and a second indoor unit outlet pipe 37.

The second heat exchanger outlet pipe 174 may be connected to the second indoor unit inlet pipe 36. Therefore, the water discharged from the second water flow path 118 of the second heat exchanger 115 may be introduced into the second indoor unit 70 through the second heat exchanger outlet pipe 174 and the second indoor unit inlet pipe 36.

The second indoor unit 70 includes a second indoor heat exchanger 71 and a second indoor fan 75. The second indoor fan 75 is disposed adjacent to the second indoor heat exchanger 71 to blow indoor air so that heat exchange occurs between the water passing through the second indoor heat exchanger 71 with the indoor air.

The second indoor unit inlet pipe 36 may be connected to an inlet-side of the second indoor heat exchanger 71. Also, the second indoor unit outlet pipe 37 may be connected to an outlet-side of the second indoor heat exchanger 71.

The second heat exchanger inlet pipe 175 may be provided with a second pump 176 for forcing a flow of water. When the second pump 176 is driven, the water may circulate through the water-side flow path connecting the second indoor unit 70 to the second heat exchanger 115, i.e., through the second indoor heat exchanger 71, the second indoor unit outlet pipe 37, the second heat exchanger inlet pipe 175, the second water flow path 118, the second heat exchanger outlet pipe 174, and the second indoor unit inlet pipe 36.

Although the second pump 176 is illustrated as being installed in the second heat exchanger inlet pipe 175 in FIG. 2, the implementation is not limited thereto. For example, the second pump 176 may be installed in the second heat exchanger outlet pipe 174.

A first branch part 131*a* is disposed on the first connection pipe 131. Also, the heat exchange device 100 further includes a fifth connection pipe 135 connected to the first branch part 131*a* to extend to the second four-way valve 125. The fifth connection pipe 135 may be connected to the first port 125*a* of the second four-way valve 125.

In some examples, the first branch part 131*a* may be a portion of the first connection pipe 131. In some examples, the first branch part 131*a* may be a separate part such as a multi-way connection pipe.

A second branch part 133*a* is disposed on the third connection pipe 133. Also, the heat exchange device 100 further includes an eighth connection pipe 138 connected to the second branch part 133*a* to extend to the second four-way valve 125. The eighth connection pipe 138 may be connected to the third port 125*c* of the second four-way valve 125.

In some examples, the second branch part 133*a* may be a portion of the first connection pipe 133. In some examples, the second branch part 133*a* may be a separate part such as a multi-way connection pipe.

The heat exchange device 100 includes the first four-way valve 120 and the second four-way valve 125, which control a flow direction of the refrigerant.

The first four-way valve 120 includes the first port 120*a* to which the first connection pipe 131 is connected, the second port 120*b* to which the second connection pipe 132 is connected, and the third port 120*c* to which the third connection pipe 133 is connected. A fourth port of the first four-way valve 120 may be closed.

The second four-way valve 125 includes a first port 125*a* to which the fifth connection pipe 135 is connected, a second port 125*b* to which the sixth connection pipe 136 is connected, and a third port 125*c* to which the eighth connection pipe 138 is connected.

The heat exchange device 100 may further include expansion valves 140 and 145 for decompressing the refrigerant. Each of the expansion valves 140 and 145 may include an electronic expansion valve (EEV).

The EEV may adjust a degree of opening thereof to allow a pressure of the refrigerant passing through the expansion valve to drop down. For example, when the expansion valve is fully opened, the refrigerant may pass through the expansion valve without dropping down, and when the degree of opening of the expansion valve decreases, the refrigerant may be decompressed. A degree of decompression of the refrigerant may increase as the degree of opening decreases.

In detail, the expansion valves 140 and 145 may include a first expansion valve 140 installed in the fourth connection pipe 134. The first expansion valve 140 may be installed at one point of the fourth connection pipe 134 between the third branch part 134*a* and an end thereof connected to the first refrigerant flow path 111.

For example, during the simultaneous operation of the air conditioning apparatus 1, a high-pressure gas refrigerant introduced through the first outdoor unit connection pipe 20 may be introduced into the first refrigerant flow path 111 of the first heat exchanger 110 and then be condensed. Also, the heating operation may be performed in the first indoor unit 60 connected to the first heat exchanger 110.

A liquid refrigerant discharged from the first refrigerant flow path 111 may not be decompressed while passing through the first expansion valve 140. A portion of the refrigerant passing through the first expansion valve 140 may be discharged to the third outdoor unit connection pipe 27 through the third service valve 28. Also, the remaining portion of the refrigerant may introduced into the seventh connection pipe 137 from the third branch part 134*a*.

The expansion valves 140 and 145 may further include a second expansion valve 145 installed in the seventh connection pipe 137.

For example, during the simultaneous operation of the air conditioning apparatus 1, the refrigerant passing through the first expansion valve 140, branched from the third branch part 134*a*, and introduced into the seventh connection pipe 137 may be decompressed into a low-pressure refrigerant while passing through the second expansion valve 145 and then be introduced into the second refrigerant flow path 116 of the second heat exchanger 115 so as to be evaporated. Also, in the second indoor unit 70 connected to the second heat exchanger 150, cooling is performed.

The low-pressure gas refrigerant discharged from the second refrigerant flow path 116 may be discharged to the second outdoor unit connection pipe 25 via the sixth connection pipe 136, the second four-way valve 125, the eighth connection pipe 138, and the third connection pipe 133.

The switching mechanism 200 may include a first bypass pipe 210 connecting the first connection pipe 131 to the third connection pipe 133. One end of the first bypass pipe 210 may be connected to a first bypass branch part 131*b* of the first connection pipe 131, and the other end thereof may be connected to a second bypass part of the third connection pipe 133.

The first branch part 131*a* may be disposed at one point between the first bypass branch part 131*b* and the first port 120*a* of the first four-way valve 120 with respect to the first connection pipe 131.

The second branch part 133*a* may be disposed at one point between the second bypass branch part 133*b* and the third port 120*c* of the first four-way valve 120 with respect to the third connection pipe 133.

The first bypass pipe 210 is provided with a first bypass valve 241 for controlling an opening and closing of the pipe. For example, the first bypass valve 241 may include a two-way valve or a solenoid valve having a relatively low pressure loss.

A first check valve 251 may be installed in the first bypass pipe 210. The first check valve 251 may allow a flow of the refrigerant from the second bypass branch part 133*b* to the first bypass branch part 131*b* and may restrict a flow of the refrigerant flow in the opposite direction.

The switching mechanism 200 may include a second bypass pipe 220 connecting the first connection pipe 131 to the fourth connection pipe 134. One end of the second bypass pipe 220 may be connected to a third bypass branch part 131*c* of the first connection pipe 131, and the other end thereof may be connected to a fourth bypass branch part 134*b* of the fourth connection pipe 134.

The third bypass branch part 131*c* may be disposed at one point between the first bypass branch part 131*b* and the first branch part 131*a* with respect to the first connection pipe 131.

The third branch part 134*a* may be disposed at one point between the fourth bypass branch part 134*b* and the fourth connection pipe 134 connected to the first refrigerant flow path 111 with respect to the fourth connection pipe 134.

The second bypass pipe 220 is provided with a second bypass valve 243 for controlling an opening and closing of the pipe. For example, the second bypass valve 243 may include a two-way valve or a solenoid valve having a relatively low pressure loss.

A second check valve 253 may be installed in the second bypass pipe 220. The second check valve 253 may allow the refrigerant to flow from the fourth bypass branch part 134*b* to the third bypass branch part 131*c* and may restrict a flow of the refrigerant in the opposite direction.

The switching mechanism 200 may include a third bypass pipe 230 connecting the third connection pipe 133 to the fourth connection pipe 134. One end of the third bypass pipe 230 may be connected to a fifth bypass branch part 133*c* of the third connection pipe 133, and the other end thereof may be connected to a sixth bypass branch part 134*c* of the fourth connection pipe 134.

The fifth bypass branch part 133*c* may be disposed at one point between the second bypass branch part 133*b* and the second branch part 133*a* with respect to the third connection pipe 133.

The sixth bypass branch part 134*c* may be disposed at one point between the fourth bypass branch part 134*b* and the third branch part 134*a* with respect to the fourth connection pipe 134.

The third bypass pipe 230 is provided with a third bypass valve 245 for controlling an opening and closing of the pipe. For example, the third bypass valve 245 may include a two-way valve or a solenoid valve having a relatively low pressure loss.

A third check valve 255 may be installed in the third bypass pipe 230. The third check valve 255 may allow the refrigerant to flow from the fifth bypass branch part 133*c* to the sixth bypass branch part 134*c* and may restrict a flow of the refrigerant in the opposite direction.

The third connection pipe 133 may be provided with a fourth check valve 257 for controlling one-way flow of the refrigerant. The fourth check valve 257 may be installed at one point of the third connection pipe 133 between the second bypass branch part 133*b* and the fifth bypass branch part 133*c*. The fourth check valve 257 may allow the refrigerant flow from the fifth bypass branch part 133*c* to the second bypass branch part 133*b* and may restrict a flow of the refrigerant flow in the opposite direction.

Figure 3:
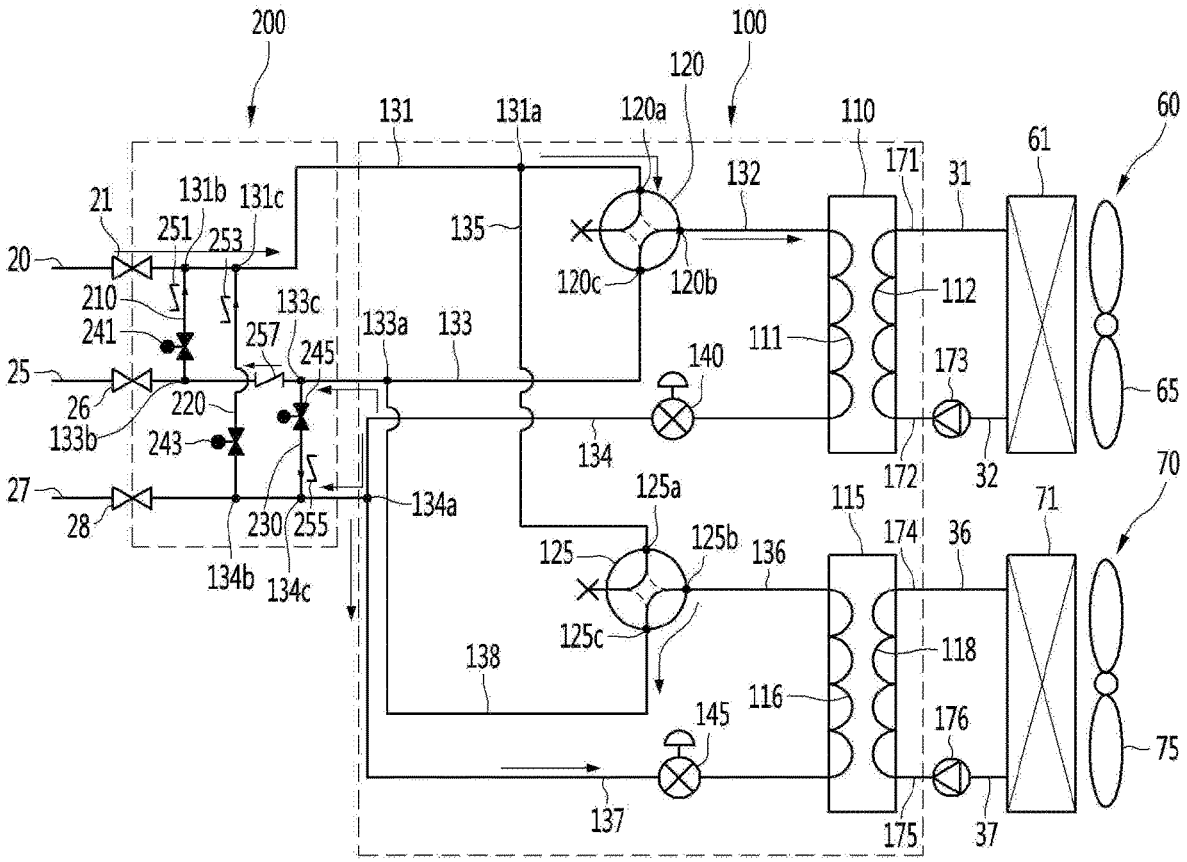
FIG. 3 is a cycle diagram illustrating an example of a flow of refrigerant in the heat exchange device and the switching mechanism during a simultaneous operation of the air conditioning apparatus.

FIG. 3 is a cycle diagram illustrating an example of a flow of a refrigerant in the heat exchange device and the switching mechanism during the simultaneous operation of the air conditioning apparatus. Referring to FIG. 3, a description will be given of a refrigerant flow during the simultaneous operation in which the cooling/heating of the air conditioning apparatus 1 are performed together.

Referring to FIG. 3, when the simultaneous operation is performed in the air conditioning apparatus 1, the high-pressure gas refrigerant compressed by the compressor 11 of the outdoor unit 10 flows to the first connection pipe 131 through the first outdoor unit connection pipe 20 and then be introduced into the first four-way valve 120 through the first port 120*a*.

The refrigerant may be discharged from the first four-way valve 120 through the second port 120*b* and may be introduced into the first refrigerant flow path 111 of the first heat exchanger 110 so as to be condensed. In the process of condensing the refrigerant in the first heat exchanger 110, water flowing through a first water flow path 112 of the first heat exchanger 110 may be heated, and the heated water may be supplied to the first indoor unit 60 to perform the heating.

The refrigerant discharged from the first heat exchanger 110 may be introduced into the fourth connection pipe 134 to pass through the first expansion valve 140. Here, since the first expansion valve 140 is completely opened, the refrigerant passing through the first expansion valve 140 may not be decompressed.

A portion of the refrigerant passing through the first expansion valve 140 may be introduced into the outdoor unit 10 through the third outdoor unit connection pipe 27 and then may be decompressed by the main expansion valve 18, evaporated in the outdoor heat exchanger 15, and suctioned into the compressor 11.

Then, the remaining refrigerant of the refrigerant passing through the first expansion valve 140 may be introduced into the seventh connection pipe 137 from the third branch part 134*a* and may be decompressed by the second expansion valve 145. Also, the decompressed refrigerant may be introduced into the second refrigerant flow path 116 of the second heat exchanger 115 so as to be evaporated. During the evaporation of the refrigerant, water flowing through the second water flow path 118 of the second heat exchanger 115 may be cooled, and the cooled water may be supplied to the second indoor unit 70 to perform the cooling.

The refrigerant discharged from the second heat exchanger 115 may be introduced into the second four-way valve 125 through the second port 125*b* and may be discharged from the second four-way valve 125 through the third port 125*c*. Also, the refrigerant may be introduced into the third connection pipe 133 from the second branch part 133*a* to flow to the outdoor unit 10 via the second outdoor unit connection pipe 25. Also, the refrigerant introduced into the outdoor unit 10 may be suctioned into the compressor 11.

On the other hand, since the third port 120*c* of the first four-way valve 120 is closed, the refrigerant may be prevented from being introduced into the first four-way valve 120 from the second branch part 133*a*. Also, since the first to third bypass valves 241, 243, and 245 are all closed, the refrigerant may be prevented to flowing in the first to third bypass pipes 210, 220, and 230.

Due to the circulation of the refrigerant and the water, the heating operation in the first indoor unit 60 and the cooling operation in the second indoor unit 70 may be performed together.

Hereinafter, a description will be made. Since the forgoing implementation are the same as another implementation except for only portions of the constitutions, different points therebetween will be described principally, and descriptions of the same parts will be denoted by the same reference numerals and descriptions of the foregoing implementation.

Figure 4:
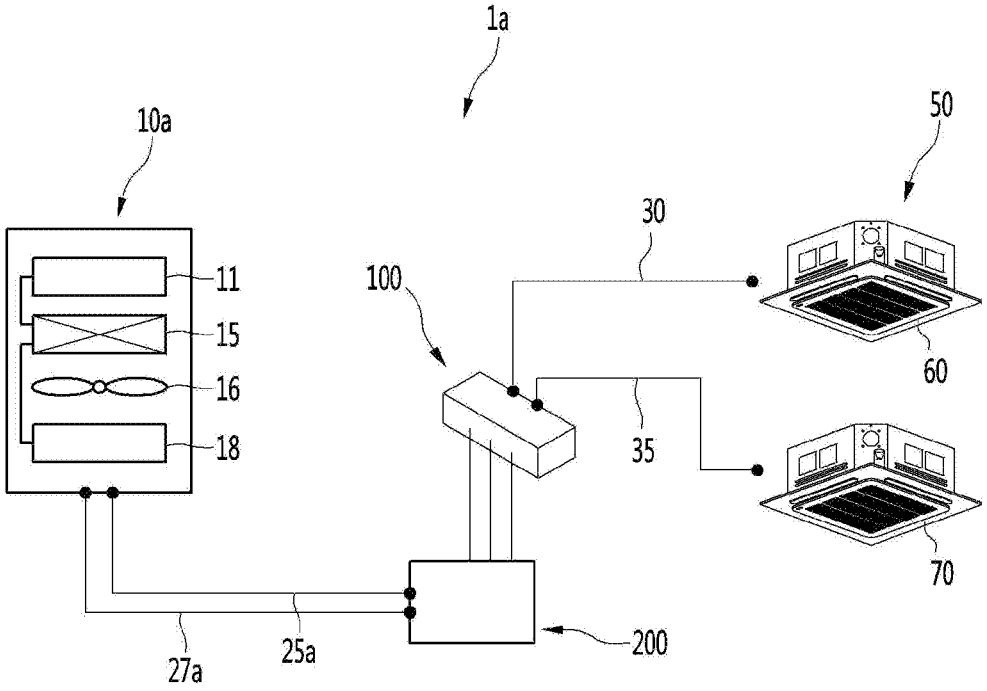
FIG. 4 is a schematic view illustrating an example configuration of an air conditioning apparatus.
Figure 5:
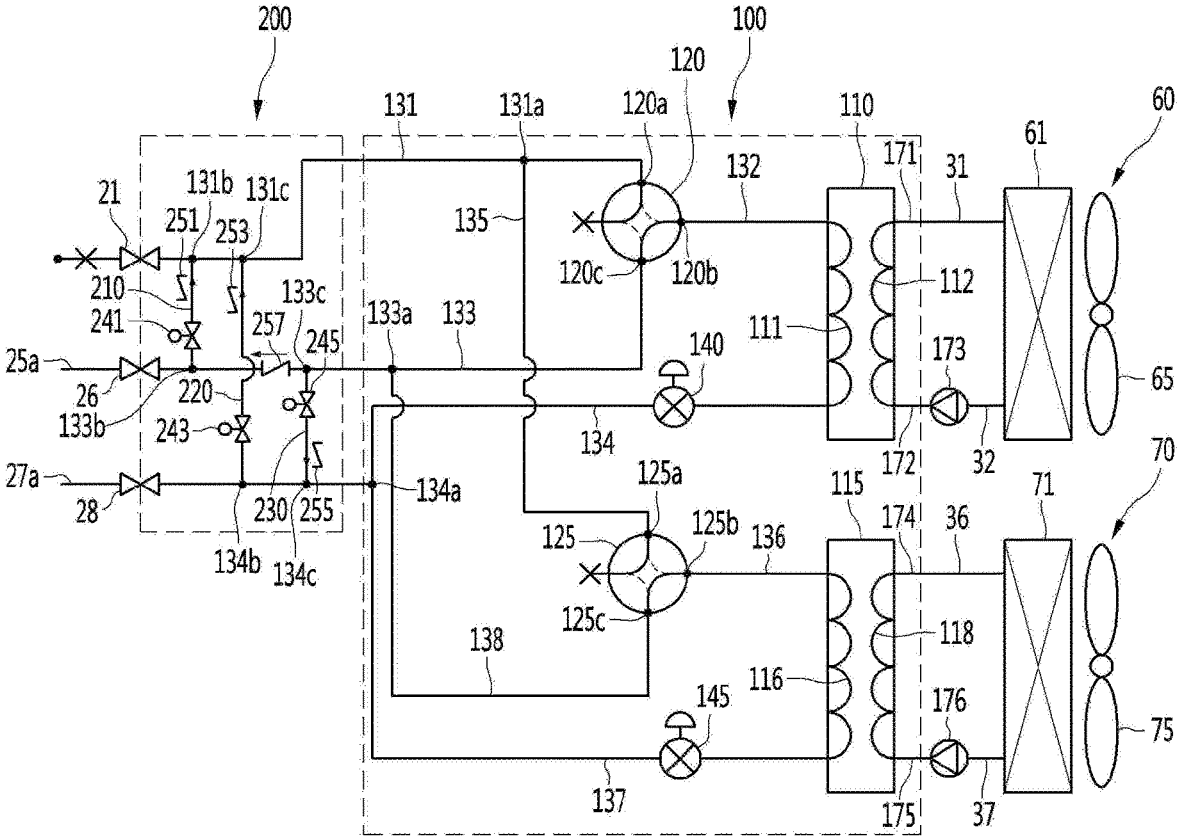
FIG. 5 is a cycle diagram illustrating an example configuration of a heat exchange device and a switching mechanism.

FIG. 4 is a schematic view illustrating an example configuration of an air conditioning apparatus, and FIG. 5 is a cycle diagram illustrating an example configuration of a heat exchange device and a switching mechanism.

Referring to FIGS. 4 and 5, an air conditioning apparatus 1*a* includes an outdoor unit 10*a*, an indoor unit 50, a switching mechanism 200 connected to the outdoor unit 10, and a heat exchange device 100 connected to the switching mechanism 200. The switching mechanism 200 may be provided between the outdoor unit 10 and the heat exchange device 100.

The switching mechanism 200 is provided so that the heat exchange device 100 is connected to a cooling/heating switching outdoor unit or a simultaneous cooling/heating outdoor unit. The switching mechanism 200 may be provided as a separate kit that is detachable to the outdoor unit or may be integrated with the outdoor unit.

Since the internal configurations of the heat exchange device 100 and the switching mechanism 200 are the same as those of the heat exchange device and the switching mechanism described according to the foregoing implementation, detailed descriptions will be omitted below, and the description of the foregoing implementation will be derived as it is.

The outdoor unit 10*a* according to this implementation may be configured as a cooling/heating switching outdoor unit.

The outdoor unit 10*a* may include a compressor 11, an outdoor heat exchanger 15, an outdoor fan 16, and a main expansion valve 18 (EEV). The above-described parts will be quoted from the descriptions of the foregoing implementation. The air conditioning apparatus 1*a* further includes two pipes 25*a* and 27*a* connecting the outdoor unit 10*a* to the heat exchange device 100. The two pipes 25*a* and 27*a* include a first outdoor unit connection pipe 25*a* as a gas pipe through which a gas refrigerant flows and a second outdoor unit connection pipe 27*a* as a liquid pipe through which a liquid refrigerant flows.

That is, the outdoor unit 10*a* and the switching mechanism 200 may have a "two pipe connection structure", and thus, the refrigerant may circulate through the outdoor unit 10*a*, the heat exchange device 100, and the switching mechanism 200 via the two pipes 25*a* and 27*a*.

The heat exchange device 100 and the indoor unit 50 may be fluidly connected to each other by water. The water may flow through a water-side flow path of a heat exchanger provided in the heat exchange device 100 and the indoor unit 50. The heat exchanger may include a plate-type heat exchanger. In some examples, the indoor unit 50 may include a first indoor unit 60 and a second indoor unit 70. Description of the connection structure between the heat exchange device 100 and the indoor unit 50 will be derived from the description according to the foregoing implementation.

A first service valve 21 may be closed by the "two pipe connection structure". That is, when the cooling/heating switchable outdoor unit 10*a* is installed, the outdoor unit 10*a* and the switching mechanism 200 may be connected to the first and second outdoor unit connection pipes 25*a* and 27*a* through second and third service valves 26 and 28, respectively. As described above, the internal configurations of the switching mechanism 200 and the heat exchange device 100 are the same as the internal configurations of the switching mechanism and the heat exchanger described according to the foregoing implementation.

Therefore, according to the installation condition of the air conditioning apparatus, even if any outdoor unit among the simultaneous outdoor unit 10 and the switchable outdoor unit 10*a* is installed, the outdoor unit, the switching mechanism, and the heat exchange device 100 may be connected to each other through the selective connection of the outdoor unit connection pipe and the service valve.

Hereinafter, a flow of a separate refrigerant for each operation mode will be described with reference to the configuration of the air conditioning apparatus 1*a* in which the switchable outdoor unit 10*a*, the switching mechanism 200, and the heat exchange device 100 are connected to each other.

Figure 6:
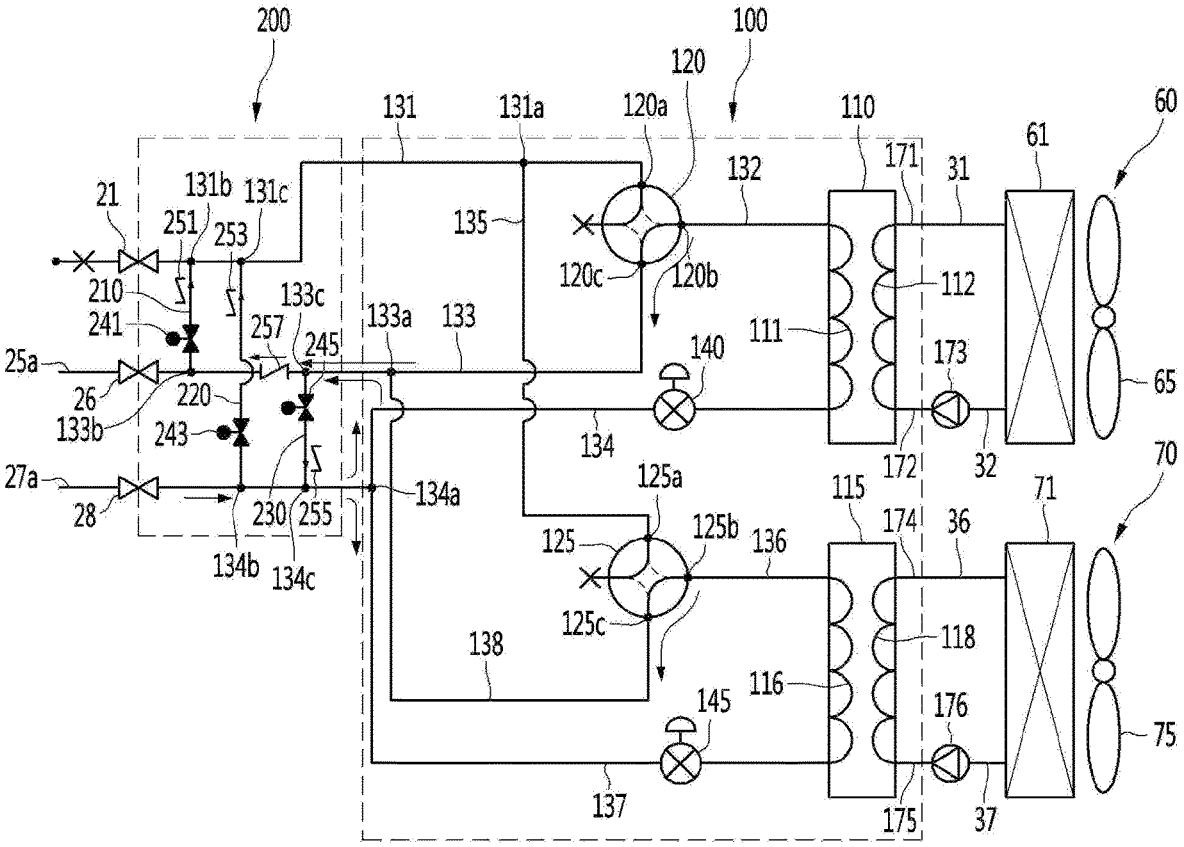
FIG. 6 is a cycle diagram illustrating an example of a flow of refrigerant in the heat exchange device and the switching mechanism during a cooling operation mode of the air conditioning apparatus.

FIG. 6 is a cycle diagram illustrating an example of a flow of a refrigerant in the heat exchange device and the switching mechanism during the cooling operation mode of the air conditioning apparatus.

Referring to FIG. 6, when the "cooling operation mode" of the air conditioning apparatus 1*a* is performed, a liquid refrigerant condensed in the outdoor heat exchanger 15 of the outdoor unit 10*a* may be introduced into a fourth connection pipe 134 through a second outdoor unit connection pipe 27*a*, and a portion of the refrigerant may be branched from a third branch part 134*a* and be introduced into a seventh connection pipe 137.

The refrigerant of the fourth connection pipe 134 may be decompressed in a first expansion valve 140 and be introduced into a first refrigerant flow path 111 of a first heat exchanger 110 and then be heat-exchanged with a first water flow path 112. Dur to the heat exchange, the refrigerant of the first refrigerant flow path 111 may be evaporated, and the water of the first water flow path 112 may be cooled. The cooled water may be introduced into the first indoor unit 60 to perform cooling.

The refrigerant of the seventh connection pipe 137 may be decompressed in a second expansion valve 145 and be introduced into a second refrigerant flow path 116 of a second heat exchanger 115 and then be heat-exchanged with a second water flow path 118. Dur to the heat exchange, the refrigerant of the second refrigerant flow path 116 may be evaporated, and the water of the second water flow path 118 may be cooled. The cooled water may be introduced into the second indoor unit 70 to perform cooling.

The refrigerant discharged from the first heat exchanger 110 may be introduced into a first four-way valve 120 through a second port 120*b* and may be discharged through a third port 120*c*. The refrigerant discharged from the first four-way valve 120 may be introduced into a third connection pipe 133 and may be introduced into the outdoor unit 10*a* through a first outdoor unit connection pipe 25*a*.

The refrigerant discharged from the second heat exchanger 115 may be introduced into a second four-way valve 125 through a second port 125*b* and may be discharged through a third port 125*c*. The refrigerant discharged from the second four-way valve 125 may be introduced into an eighth connection pipe 138 and may be introduced into a third connection pipe 133 from a second branch part 133*a*. Also, the refrigerant may be introduced into the outdoor unit 10*a* through the first outdoor unit connection pipe 25*a*.

The refrigerant introduced into the outdoor unit 10*a* may be suctioned into the compressor 11. Since first to third bypass valves 241, 243 and 245 are all closed during the cooling operation, a flow of the refrigerant through the first to third bypass pipes 210, 220, and 230 may be restricted. This refrigerant cycle may circulate.

Figure 7:
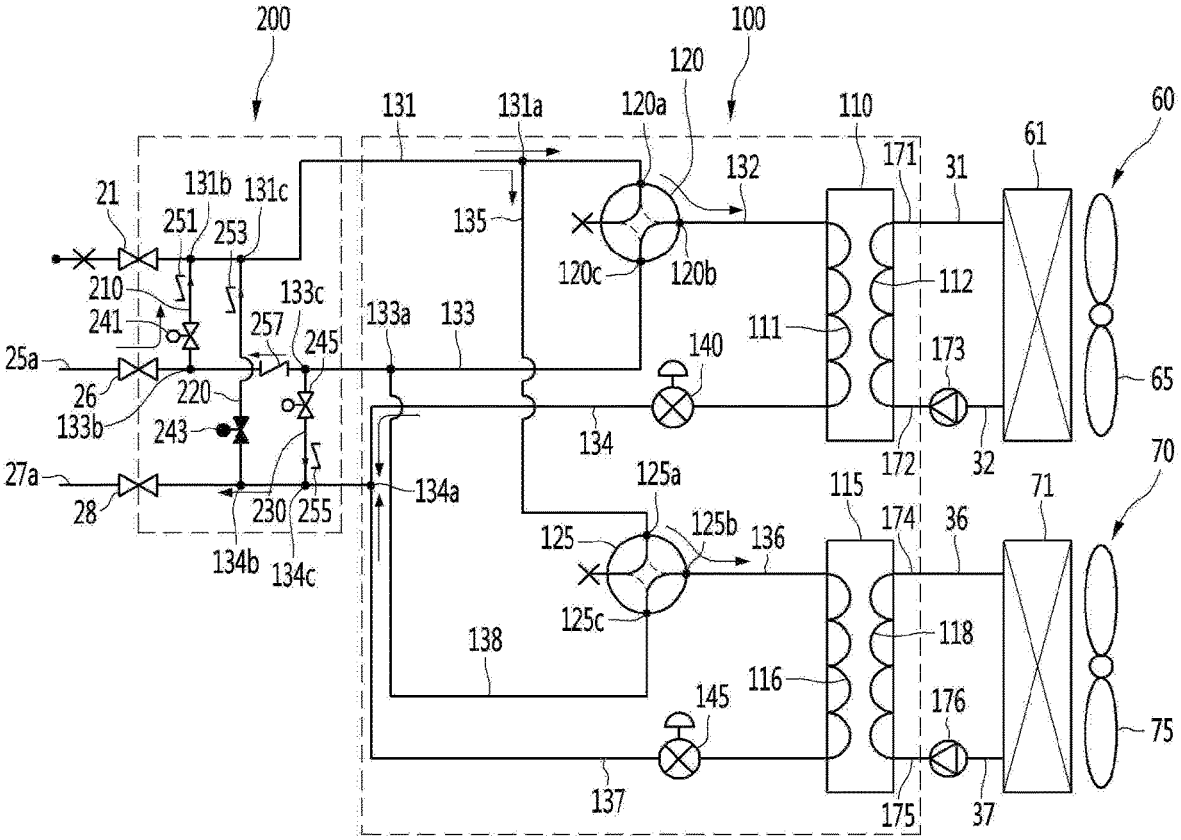
FIG. 7 is a cycle diagram illustrating an example of a flow of the refrigerant in the heat exchange device and the switching mechanism during a heating operation switching mode of the air conditioning apparatus.

FIG. 7 is a cycle diagram illustrating an example of a flow of the refrigerant in the heat exchange device and the switching mechanism during a heating operation switching mode of the air conditioning apparatus.

While the cooling operation of the air conditioning apparatus 1*a* is performed as shown in FIG. 6, when a switching signal for the heating operation is inputted to the air conditioning apparatus 1*a*, a "heating operation switching mode" may be performed.

In a state in which second ports 120*b* and 125*b* and third ports 120*c* and 125*c* are opened, and first ports 120*a* and 125*a* are closed in first and second four-way valves 120 and 125 according to the cooling operation, when the heating operation is performed, the switching ports of the first and second four-way valves 120 and 125 may be changed.

To allow the switching operation of the first and second four-way valves 120 and 125 to be easily performed, an internal differential pressure between the first and second four-way valves 120 and 125 may need to be equal to or greater than a set pressure. For example, the set pressure may be about 350 kpa.

To allow the internal differential pressure between the first and second four-way valves 120 and 125 to be equal to or greater than the set pressure, a "heating operation switching mode" may be performed at an initial time at which the heating operation is performed.

When the heating operation switching mode is performed, the refrigerant compressed by the compressor 11 of the outdoor unit 10*a* may be introduced into the third connection pipe 133 through the first outdoor unit connection pipe 25*a*. Here, since the first bypass valve 241 is opened, the refrigerant may be introduced into a first bypass pipe 210 from a second bypass branch part 133*b*. Also, the refrigerant may be prevented from flowing from a second bypass branch part 133*b* to a fifth bypass branch part 133*c* by a fourth check valve 257.

The refrigerant of the first bypass pipe 210 is introduced into a first connection pipe 131 from a first bypass branch part 131*b* and is introduced into the first four-way valve 120 through the first port 120*a*. A portion of the refrigerant of the first connection pipe 131 may be introduced from the first branch part 131*a* to the fifth connection pipe 135 and be introduced into the second four-way valve 125 through the first port 125*a*.

The refrigerant introduced into the first four-way valve 120 may be discharged through the second port 120*b* and introduced into the first heat exchanger 110, and the refrigerant introduced into the second four-way valve 125 may be discharged through the second port and be introduced into the second heat exchanger 115 through the second port 125*b*. That is, each of the first ports 120*a* and 125*a* and each of the second ports 120*b* and 125*b* of the first and second four-way valves 120 and 125 may be opened to generate a high pressure, and the third ports 120*c* and 125*c* may be closed to generate a low pressure.

The refrigerant flowing through the first and second heat exchangers 110 and 115 may be heat-exchanged with water to heat the water. The heated water may be introduced into the first and second indoor units 60 and 70 to perform heating. Also, the refrigerant condensed in the first heat exchanger 110 may be decompressed while passing through the first expansion valve 140 of the fourth connection pipe 134, and the refrigerant condensed in the second heat exchanger 115 may be decompressed while passing through the second expansion valve 145 of the seventh connection pipe 137.

Also, the refrigerant passing through the first and second expansion valves 140 and 145 may be mixed with each other in the third branch part 134*a* and may be introduced into the outdoor unit 10*a* through the second outdoor unit connection pipe 27*a*. The refrigerant introduced into the outdoor unit 10*a* may be additionally decompressed in the main expansion valve 18, evaporated in the outdoor heat exchanger 15, and then suctioned into the compressor 11.

The second bypass valve 243 may be closed, and the third bypass valve 245 may be opened. Accordingly, the third connection pipe 133 and the eighth connection pipe 138 may be connected to a low pressure-side environment through the third bypass pipe 230. That is, the third and eighth connection pipes 133 and 138 connected to the third ports 120*c* and 125*c* requiring the low pressure in the first and second four-way valves 120 and 125 may be connected to the second outdoor unit connection pipe 27*a* to easily generate the low pressure.

However, the refrigerant of the fourth connection pipe 134 may be prevented from flowing to the third bypass pipe 230 by the third check valve 255. When it is detected that the switching to the heating operation mode is performed in the first and second four-way valves 120 and 125 by the circulation of the refrigerant, the heating operation mode may be performed as described below.

Figure 8:
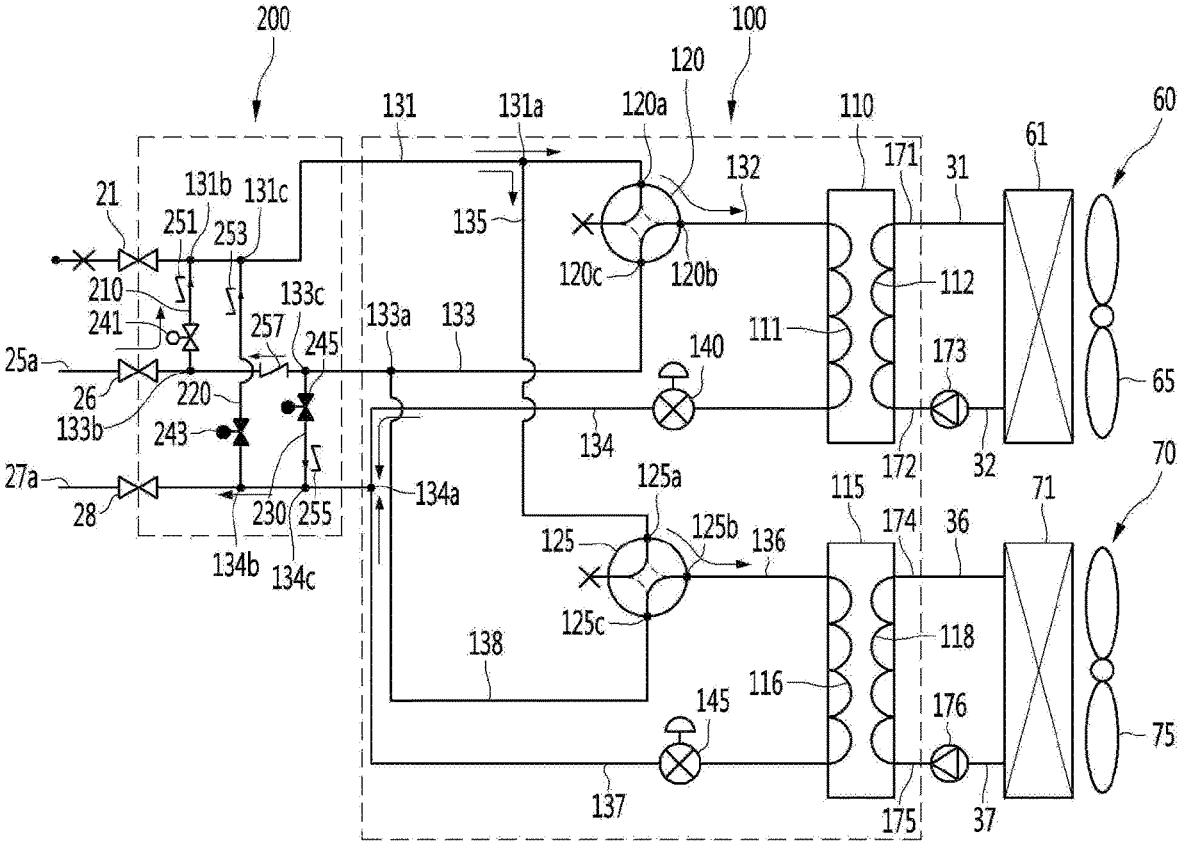
FIG. 8 is a cycle diagram illustrating an example of a flow of the refrigerant in the heat exchange device and the switching mechanism during a heating operation mode of the air conditioning apparatus.

FIG. 8 is a cycle diagram illustrating an example of a flow of the refrigerant in the heat exchange device and the switching mechanism during the heating operation mode of the air conditioning apparatus.

Referring to FIG. 8, the heating operation mode in the air conditioning apparatus 1*a* is substantially similar to the "heating operation switching mode", except that the third bypass valve 245 is closed.

That is, when the heating operation is performed, the refrigerant compressed by the compressor 11 of the outdoor unit 10*a* may be introduced into the third connection pipe 133 through the first outdoor unit connection pipe 25*a*. Here, since the first bypass valve 241 is opened, the refrigerant may be introduced into a first bypass pipe 210 from a second bypass branch part 133*b*. Also, the refrigerant may be prevented from flowing from a second bypass branch part 133*b* to a fifth bypass branch part 133*c* by a fourth check valve 257.

The refrigerant of the first bypass pipe 210 may be introduced into the first four-way valve 120 through the first connection pipe 131, and a portion of the refrigerant may be introduced into the fifth connection pipe 135 from the first branch part 131*a* and may be introduced into the second four-way valve 125.

The refrigerant introduced into the first four-way valve 120 may be discharged through the second port 120*b* and introduced into the first heat exchanger 110, and the refrigerant introduced into the second four-way valve 125 may be discharged through the second port and be introduced into the second heat exchanger 115 through the second port 125*b*.

The refrigerant flowing through the first and second heat exchangers 110 and 115 may be heat-exchanged with water to heat the water. The heated water may be introduced into the first and second indoor units 60 and 70 to perform heating. Also, the refrigerant condensed in the first heat exchanger 110 may be decompressed while passing through the first expansion valve 140 of the fourth connection pipe 134, and the refrigerant condensed in the second heat exchanger 115 may be decompressed while passing through the second expansion valve 145 of the seventh connection pipe 137.

Also, the refrigerant passing through the first and second expansion valves 140 and 145 may be mixed with each other in the third branch part 134*a* and may be introduced into the outdoor unit 10*a* through the second outdoor unit connection pipe 27*a*. The refrigerant introduced into the outdoor unit 10*a* may be additionally decompressed in the main expansion valve 18, evaporated in the outdoor heat exchanger 15, and then suctioned into the compressor 11.

The second bypass valve 243 and the third bypass valve 245 may be closed. Also, the refrigerant of the fourth connection pipe 134 may be prevented from flowing to the third bypass pipe 230 by the third check valve 255. Due to the circulation of the refrigerant, the heating operation in the first and second indoor units 60 and 70 may be performed.

Figure 9:
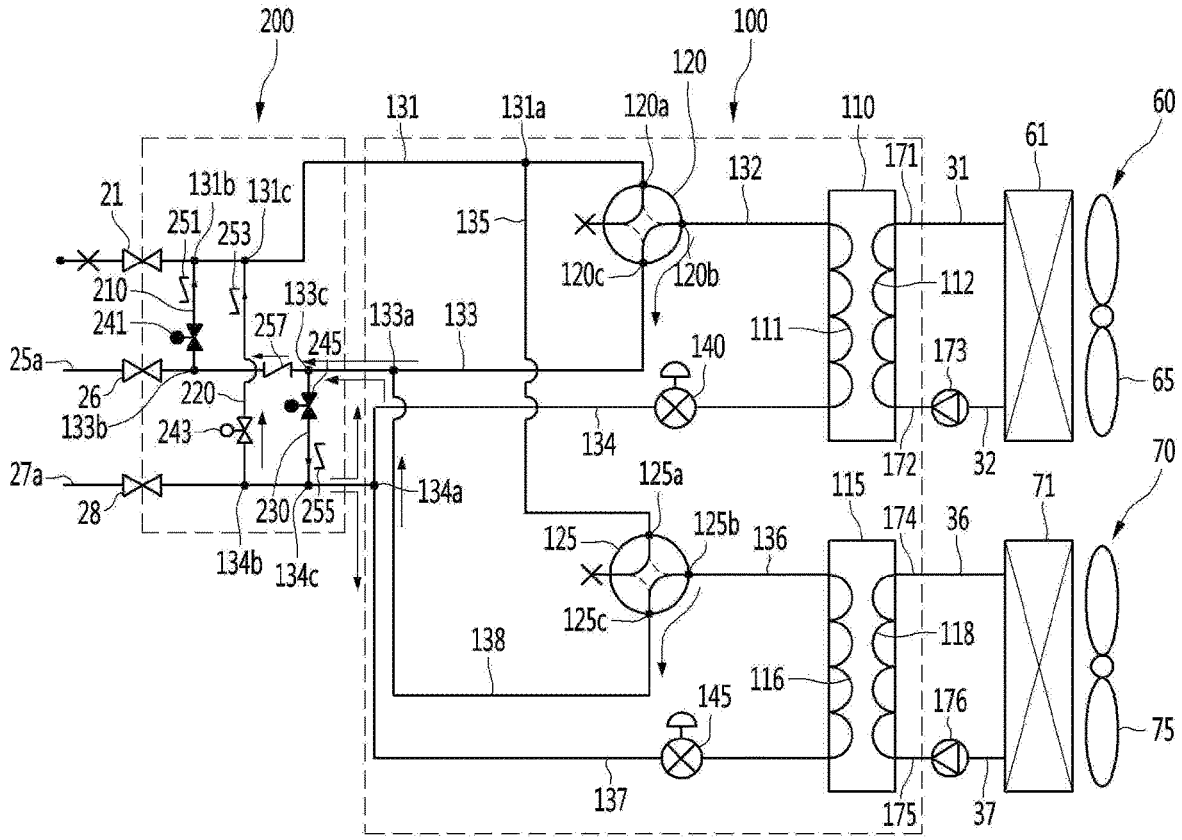
FIG. 9 is a cycle diagram illustrating an example of a flow of the refrigerant in the heat exchange device and the switching mechanism during a cooling operation switching mode of the air conditioning apparatus.

FIG. 9 is a cycle diagram illustrating an example of a flow of the refrigerant in the heat exchange device and the switching mechanism during a cooling operation switching mode of the air conditioning apparatus.

While the heating operation mode as shown in FIG. 8 is performed, a signal for performing the cooling operation may be inputted. In this case, as the cooling operation mode starts, a "cooling operation switching mode" may be performed at the beginning of the cooling operation mode.

In detail, when the "cooling operation switching mode" is performed, the refrigerant condensed in the outdoor heat exchanger 15 of the outdoor unit 10*a* may be introduced into the fourth connection pipe 134 through the second outdoor unit connection pipe 27*a*.

The refrigerant of the fourth connection pipe 134 may be decompressed in the first expansion valve 140 and then be introduced into the first heat exchanger 110, and a portion of the refrigerant may be branched from the third branch part 134*a* to the seventh connection pipe, decompressed in the second expansion valve 145, and introduced into the second heat exchanger. Also, the refrigerant may be evaporated by being heat-exchanged with the first and second water flow paths 112 and 118 in the first and second heat exchangers 110 and 115, respectively. In this process, the water of the first and second water flow paths 112 and 118 may be cooled to perform the cooling operation of the first and second indoor units 60 and 70.

The refrigerant discharged from the first heat exchanger 110 may be introduced into the first four-way valve 120 through the second port 120*b* and may be discharged from the first four-way valve 120 through the third port 120*c*. Also, the refrigerant discharged from the second heat exchanger 115 may be introduced into the second four-way valve 125 through the second port 125*b* and may be discharged from the second four-way valve 125 through the third port 125*c*.

The refrigerant discharged from the first four-way valve 120 flows through the third connection pipe 133, and the refrigerant discharged from the second four-way valve 125 flows through the eighth connection pipe 138 and then is mixed with the refrigerant of the third connection pipe 133 in the second branch part 133*a*. The mixed refrigerant may be introduced into the outdoor unit 10*a* through the first outdoor unit connection pipe 25*a* and suctioned into the compressor 11.

The second bypass valve 243 may be opened, and the third bypass valve 245 may be closed. Therefore, a portion of the refrigerant of the fourth connection pipe 134 may be introduced into the first connection pipe 131 through the second bypass pipe 220. The refrigerant of the first connection pipe 131 may be introduced into the first four-way valve 120 through the first port 120*a*.

In some examples, a portion of the refrigerant may be introduced into the fifth connection pipe 135 from the first branch part 131*a* and may be introduced into the second four-way valve 125 through the first port 125*a*.

Therefore, a high pressure may be generated at a side of the first port 120*a* within the first four-way valve 120, and thus, the second and third ports 120*b* and 120*c* in which the refrigerant flows may communicate with each other to generate a low pressure. Therefore, a differential pressure may be secured between the first port 120*a* and the second and third ports 120*b* and 120*c*. As a result, switching to the cooling operation may be made easily.

Also, a high pressure may be generated at a side of the first port 125*a* within the second four-way valve 125, and thus, the second and third ports 125*b* and 125*c* in which the refrigerant flows may communicate with each other to generate a low pressure. Therefore, a differential pressure may be secured between the first port 125*a* and the second and third ports 125*b* and 125*c*. As a result, switching to the cooling operation may be made easily.

In the "cooling operation switching mode" process, when the differential pressure is detected to be a set differential pressure, for example, about 350 kpa or more, the second bypass valve 243 may be controlled to be closed, and the "cooling operation mode" described in FIG. 6 may be performed.

In some implementations, the heat exchange device performing the heat exchange between the water and the refrigerant may increases in degree of freedom of the installation by the switching mechanism that is capable of being connected to the switchable outdoor unit and the simultaneous outdoor unit, which have the internal configurations different from each other.

The switching mechanism may be configured to be connected to the simultaneous outdoor unit through the three pipes and to be connected to the switchable outdoor unit through the two pipes and may be disposed between the heat exchange device and the outdoor unit so that the heat exchange device performing the heat exchange between the water and the refrigerant increases in degree of freedom of the installation.

The switching mechanism may include the bypass pipe through which the four-way valve and the connection pipe of the refrigerant having the specific pressure to generate the high pressure or the low pressure at the specific port of the four-way valve communicate with each other so that an internal differential pressure of the four-way valve is used when changing a cooling operation mode or a heating operation mode.

The internal differential pressure may be sufficiently secured to improve the operation reliability of the four-way valve in the cooling operation mode or the heating operation mode.

Although implementations have been described with reference to a number of illustrative implementations thereof, it should be understood that numerous other modifications and implementations can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioning apparatus comprising:

an outdoor unit configured to circulate refrigerant, the outdoor unit comprising a compressor and an outdoor heat exchanger;

an indoor unit configured to circulate water;

a first heat exchanger and a second heat exchanger that are configured to perform heat exchange between the refrigerant and the water;

a first four-way valve disposed at one side of the first heat exchanger and configured to adjust a flow direction of the refrigerant in the first heat exchanger;

a second four-way valve disposed at one side of the second heat exchanger and configured to adjust a flow direction of the refrigerant the second heat exchanger;

a first connection pipe connected to the outdoor unit and to a first port of the first four-way valve;

a second connection pipe connected to a second port of the first four-way valve and to the first heat exchanger;

a third connection pipe connected to a third port of the first four-way valve;

a fourth connection pipe connected to the first heat exchanger;

a first expansion valve installed at the fourth connection pipe;

at least one bypass pipe configured to connect two connection pipes among the first connection pipe, the third connection pipe, and the fourth connection pipe to each other, the at least one bypass pipe being configured to guide the refrigerant between the two connection pipes; and at least one bypass valve installed at the at least one bypass pipe, wherein the at least one bypass pipe comprises:

a first bypass pipe connected to a first bypass branch part disposed at the first connection pipe and to a second bypass branch part disposed at the third connection pipe, and a second bypass pipe connected to a third bypass branch part disposed at the first connection pipe and to a fourth bypass branch part disposed at the fourth connection pipe.

2. The air conditioning apparatus according to claim 1, wherein the at least one bypass valve comprises a first bypass valve installed at the first bypass pipe.

3. The air conditioning apparatus according to claim 1, wherein the at least one bypass valve comprises a first bypass valve installed at the first bypass pipe and a second bypass valve installed at the second bypass pipe.

4. The air conditioning apparatus according to claim 3, wherein the at least one bypass pipe further comprises a third bypass pipe connected to a fifth bypass branch part disposed at the third connection pipe and to a sixth bypass branch part disposed at the fourth connection pipe.

5. The air conditioning apparatus according to claim 4, wherein the at least one bypass valve comprises a third bypass valve installed at the third bypass pipe.

6. The air conditioning apparatus according to claim 4, further comprising a first check valve installed at the first bypass pipe, a second check valve installed at the second bypass pipe, and a third check valve installed at the third bypass pipe.

7. The air conditioning apparatus according to claim 6, wherein the third check valve is installed at a point between the second bypass branch part and the fifth bypass branch part.

8. The air conditioning apparatus according to claim 1, further comprising:

a first branch part disposed at the first connection pipe; and a fifth connection pipe connected to the first branch part and to a first port of the second four-way valve.

9. The air conditioning apparatus according to claim 8, further comprising:

a sixth connection pipe connected to a second port of the second four-way valve and to the second heat exchanger.

10. The air conditioning apparatus according to claim 9, further comprising:

a second branch part disposed at the third connection pipe;

a third branch part disposed at the fourth connection pipe;

a seventh connection pipe connected to the second heat exchanger and to the third branch part; and a second expansion valve installed at the seventh connection pipe.

11. The air conditioning apparatus according to claim 10, further comprising:

an eighth connection pipe connected to the second branch part and to a third port of the second four-way valve.

12. The air conditioning apparatus according to claim 1, further comprising:

a first outdoor unit connection pipe disposed in the outdoor unit and connected to the first connection pipe;

a second outdoor unit connection pipe disposed in the outdoor unit and connected to the third connection pipe; and a third outdoor unit connection pipe disposed in the outdoor unit and connected to the fourth connection pipe.

13. The air conditioning apparatus according to claim 1, further comprising:

a first outdoor unit connection pipe connected to the outdoor unit and to the third connection pipe; and a second outdoor unit connection pipe connected to the outdoor unit and to the fourth connection pipe.

14. The air conditioning apparatus according to claim 1, wherein the indoor unit comprises:

a first indoor unit connected to the first heat exchanger; and a second indoor unit connected to the second heat exchanger.

15. An air conditioning apparatus comprising:

an outdoor unit configured to circulate refrigerant;

an indoor unit configured to circulate water;

a first heat exchanger and a second heat exchanger that are configured to perform heat exchange between the refrigerant and the water, each of the first heat exchanger and the second heat exchanger being fluidly connected to the outdoor unit and the indoor unit;

a first four-way valve disposed at one side of the first heat exchanger and configured to adjust a flow direction of the refrigerant in the first heat exchanger;

a second four-way valve disposed at one side of the second heat exchanger and configured to adjust a flow direction of the refrigerant in the second heat exchanger;

a first connection pipe connected to the outdoor unit and to a first port of the first four-way valve;

a second connection pipe connected to a second port of the first four-way valve and to the first heat exchanger;

a third connection pipe connected to a third port of the first four-way valve;

a fourth connection pipe connected to the first heat exchanger;

a first bypass pipe connected to a first bypass branch part disposed at the first connection pipe and to a second bypass branch part disposed at the third connection pipe;

a first bypass valve installed at the first bypass pipe;

a second bypass pipe connected to a third bypass branch part disposed at the first connection pipe and to a fourth bypass branch part disposed at the fourth connection pipe; and a second bypass valve installed at the second bypass pipe.

16. The air conditioning apparatus according to claim 15, further comprising a first expansion valve installed at the fourth connection pipe.

17. The air conditioning apparatus according to claim 16, further comprising:

a third bypass pipe connected to a fifth bypass branch part disposed at the third connection pipe and to a sixth bypass branch part disposed at the fourth connection pipe; and a third bypass valve installed at the third bypass pipe.

18. The air conditioning apparatus according to claim 16, further comprising:

a fifth connection pipe connected to a first branch part disposed at the first connection pipe and to a first port of the second four-way valve;

a sixth connection pipe connected to a second port of the second four-way valve and to the second heat exchanger;

a seventh connection pipe connected to the second heat exchanger and to a third branch part disposed at the fourth connection pipe; and a second expansion valve installed at the seventh connection pipe.

* * * * *